United States Patent [19]

Porter

[11] 4,424,772

[45] Jan. 10, 1984

[54] INTERNAL COMBUSTION ENGINE VALVE ACTUATING CAM

[76] Inventor: Gary N. Porter, 143 E. Hind Dr., Honolulu, Hi. 96821

[21] Appl. No.: 317,839

[22] Filed: Nov. 3, 1981

[51] Int. Cl.[3] ..... F02D 39/04; F02B 75/02; F02B 33/10; F02B 33/22

[52] U.S. Cl. ..... 123/65 VB; 123/65 VC; 123/59 BA; 123/59 BL; 123/196 R; 123/70 V; 123/71 V; 123/90.6

[58] Field of Search ..... 123/65 VB, 65 R, 59 BA, 123/59 BL, 70 V, 71 VA, 71 V, 74 VA, 196 R, 265, 658, 65 VC, 90.6

[56] References Cited

U.S. PATENT DOCUMENTS

| | | | |
|---|---|---|---|
| 1,014,078 | 1/1912 | McGuire | 123/59 BA |
| 1,037,383 | 9/1912 | Wermicke | 123/196 R |
| 1,271,140 | 7/1918 | Dickey | 123/196 R |
| 1,329,238 | 1/1920 | Golata | 123/59 BA |
| 1,542,765 | 6/1925 | Garson | 123/196 R |
| 1,632,478 | 6/1927 | Hubbell | 123/65 VB |

FOREIGN PATENT DOCUMENTS

| | | | |
|---|---|---|---|
| 337406 | 2/1904 | France | 123/70 V |

*Primary Examiner*—Wendell E. Burns

[57] ABSTRACT

A two stroke internal combustion engine with piston and cylinder has a crankshaft having peripheral gears and a cam both affixed to the same crankshaft throw. A trough is in the engine crankcase whereby the gears pass through lubrication.

8 Claims, 8 Drawing Figures

INTERNAL COMBUSTION ENGINE VALVE ACTUATING CAM

BACKGROUND OF THE INVENTION

1. Field of the Invention

This invention relates to the actuation of valves in internal combustion engines, and more particularly to cam and pushrod assemblies for accomplishing opening and closing of the valves at desired angular positions of the crankshaft.

2. Description of the Prior Art

Most internal combustion engines operate the intake and exhaust valves from rotating camshafts having lobes formed to lift the valve heads from their seats, either directly through valve rods. In the case of valve-in-head engines, the valves are operated by means of lifter rods actuated by the cams and acting on the valves through rocker arms. Problems are encountered in driving separate camshafts in accurate synchronization with the rotation of the crankshaft, both gears and belts being used for this purpose. These systems are expensive to manufacture and synchronization is lost as the gears wear and/or the belts stretch.

The present invention proposes forming or mounting the valve operating cam directly on the engine crankshaft for rotation therewith. The only disclosure that might be characterized as prior art known to applicant is Blodgett U.S. Pat. No. 1,183,795, which utilizes cams formed on the crankshaft throws to operate the valves. In Blodgett the valve rods are not pushed directly by the eccentric cams. Instead, separate members, held and positioned by five fingers, are utilized; apparently to accomodate the system to a four stroke cycle engine. This is necessary because, in a four stroke engine, the crankshaft rotates twice for each opening of the valve.

The structure of the present invention completely eliminates the complicated mechanism of Blodgett. As utilized with two-stroke engines, the apparatus of the present invention is simple and sturdy, and avoids any problems of synchronizing the cam with the crankshaft, since they rotate together.

SUMMARY OF THE INVENTION

The apparatus of the present invention utilizes what may be termed a combined camshaft-crankshaft arrangement, in which the valve operating cam is mounted, within the crankcase, on the crankshaft for joint rotation therewith. This eliminates any need for a separate camshaft, lubrication of the gear train driving the camshaft from the crankshaft, etc. The cam may be fixably or removably mounted directly on the shaft, or on the outer side of the outer crank throw, or as illustrated in the accompany drawings, by incorporating it into a combined modified fly wheel and splash lubrication gear.

Preferably, the combined camshaft-crankshaft is used in a novel two-stroke engine which eliminates many of the problems encountered in two-stroke engines utilizing either loop-scavenging, or uni-flow, or through-flow designs. It should be noted that two-stroke engines are capable of surprising power output considering their size. Some two-stroke engines, such as those used in racing motorcycles, can produce as high as four horse power or more per cubic inch.

Conventional two-stroke engines having high power, output provide relatively low fuel efficiency because large amounts of fuel-air mixture are lost in the scavenging process. Also, conventional two-strokes are difficult to start, are prone to fouling of their plugs, and produce excessive exhaust smoke.

The engine of the present invention is relatively easy to start, largely avoids spark plug fouling, and has reduced exhaust emissions.

The present engine utilizes a single poppet-type valve for each cylinder, with exhaust valving being through an exhaust port in the cylinder wall which is uncovered at the bottom of the stroke of the piston. The cam is arranged to open the intake valve part way through the power stroke, just as the internal pressure in the cylinder drops below the pressure of the air supply to the intake valve, so that further downward movement of the piston draws air into the cylinder and mixes it with the products of combustion therein. The intake valve closes shortly after the exhaust port is uncovered, and the arrangement is such that most of the products of combustion are swept out of the cylinder before the intake valve closes.

It is therefore an object of the present invention to provide a combined camshaft-crankshaft in which securing the cam directly to the crankshaft ensures that the cam will always rotate in accurate synchronization with the crankshaft.

Another object of the present invention is to provide an internal combustion engine utilizing the described combined camshaft-crankshaft and having an improved mode of removing exhaust gas from the cylinder.

A further object of the invention is to provide an engine of the character described which affords improved fuel economy and is clear running.

A still further object of the present invention is to provide apparatus of the character described which is simple, sturdy, and well adapted to conventional production methods.

Other objects and features of advantage will become apparent as the specification progresses and from the claims herein.

Figure 2:
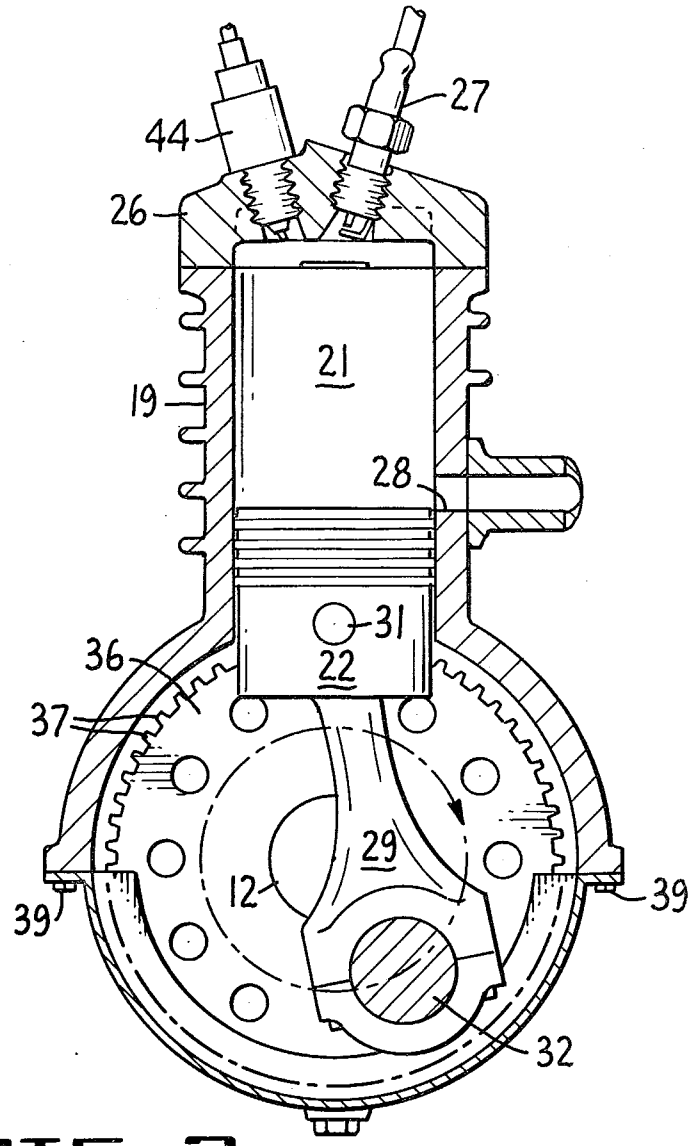
FIG. 2 is a vertical cross sectional view taken substantially on the plane of line 2—2 of FIG. 1.

While only the preferred form of the invention is illustrated in the drawings, it will be apparent that various modifications could be made without departing from the ambit of the claims.

DESCRIPTION OF THE PREFERRED EMBODIMENTS

As may be seen in the accompanying drawings, the engine of the present invention utilizes a novel camshaft-crankshaft in which a cam 11 is carried for joint rotation on an otherwise generally conventional crankshaft 21 for actuating an elongated lifter rod 13 operatively connected to the stem 14 of an air intake valve 16, a cam follower roller 17 being journaled on the end of the lifter rod 13 remote from the valve stem 14 and urged against the cam 11 by spring means 18.

While the camshaft-crankshaft of the present invention may be used with a wide variety of engine designs, it is particularly effective with the two-stroke engine illustrated in the drawings. While a one cylinder engine is illustrated, it should be appreciated that multiple cylinder engines could be constructed utilizing the principles and structure set forth herein in connection with the single cylinder engine shown in the drawings.

The engine of the present invention includes a block 19 providing a cylinder 21, a piston 22 reciprocable in the cylinder 19, and an air inlet passage 23 for admitting air to a combustion chamber 24 formed in a cylinder head 26.

As here shown, the engine is provided with a conventional spark plug 27 for initiating combustion in chamber 24 although the principles of the present invention could be used in a diesel engine. The wall of cylinder 21 is provided with an exhaust port 28 through which products of combustion are expelled although the combined camshaft-crankshaft could be used with poppet valves for both intake and exhaust by providing a second cam next to the first, or on another throw. A conventional connecting rod 29 has its upper end journaled on wristpin 31 carried on piston 22, and its lower end journaled onto a crankpin 32 mounted on crank throws 33 and 34.

The crankshaft throw 33 is here incorporated into and forms part of a lubrication splash gear 36 having peripheral teeth 37. An oil reservoir pan 38 is removably secured to the bottom of the cylinder block 19 by bolts 39, and is formed to provide a U-shaped trough 41 through which the lower portion of gear 36 passes. Trough 41 confines and channels the action of gear teeth 37 to accomplish improved lubrication.

Figure 1:
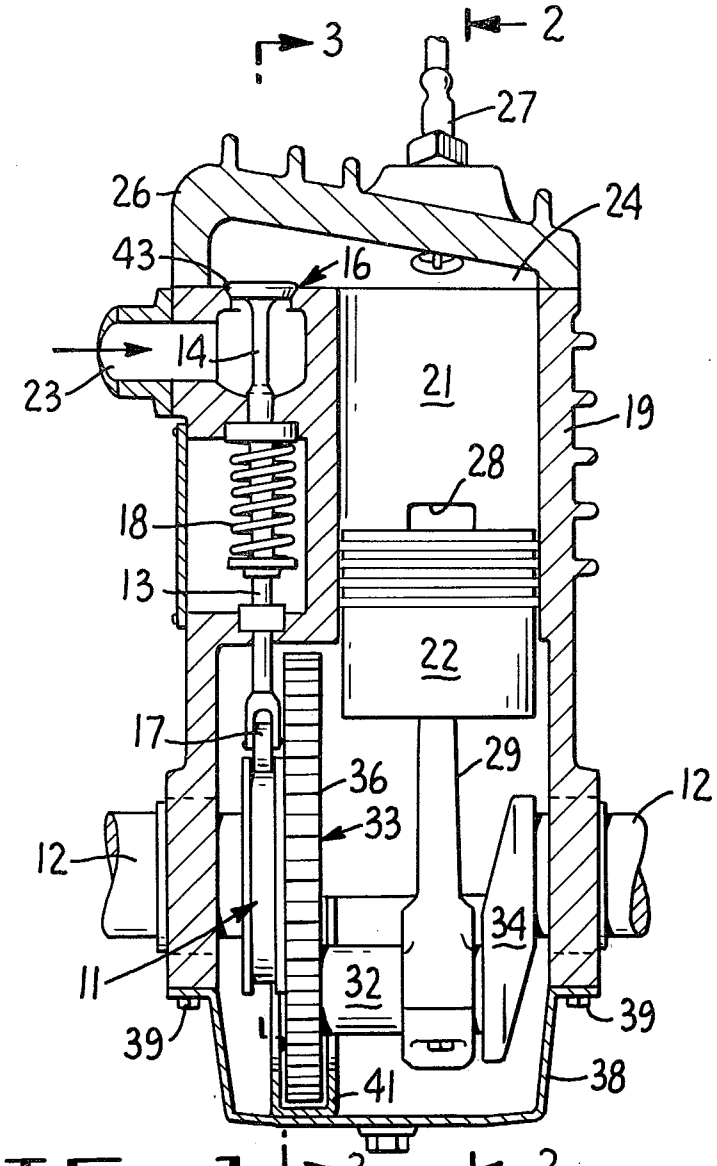
FIG. 1 is a vertical longitudinal sectional view through an engine having a combined camshaft-crankshaft constructed in accordance with the present invention.
Figure 4:
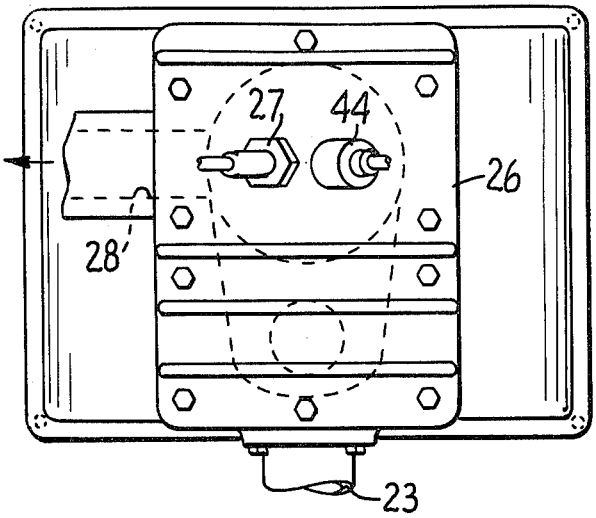
FIG. 4 is a plan view of the engine of FIG. 1 through 3.
Figure 3:
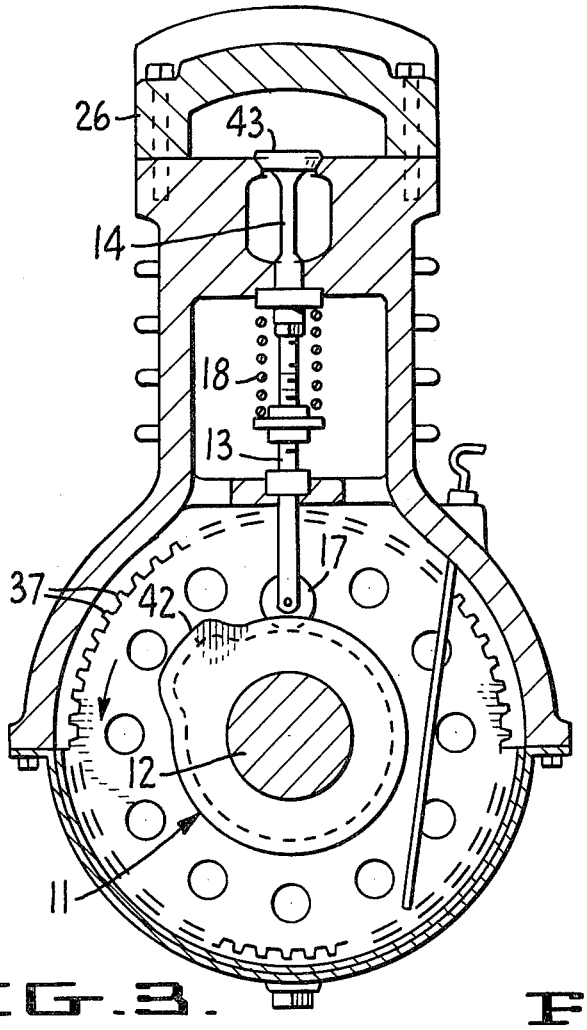
FIG. 3 is a vertical cross sectional view taken substantially on the plane of line 3—3 of FIG. 1.

Preferably, cam 11 is secured to the side of splash gear 36 opposite to crank pin 32 in the manner best seen in FIGS. 1 and 3 of the drawings. As cam 11 rotates with crankshaft 12, the cam lobe 42 urges upwardly the assembly consisting of cam follower roller 17, lifter rod 13, valve stem 14, and valve head 43 to admit air through passage 23 into the combustion chamber 24 and cylinder 21.

Figure 5:
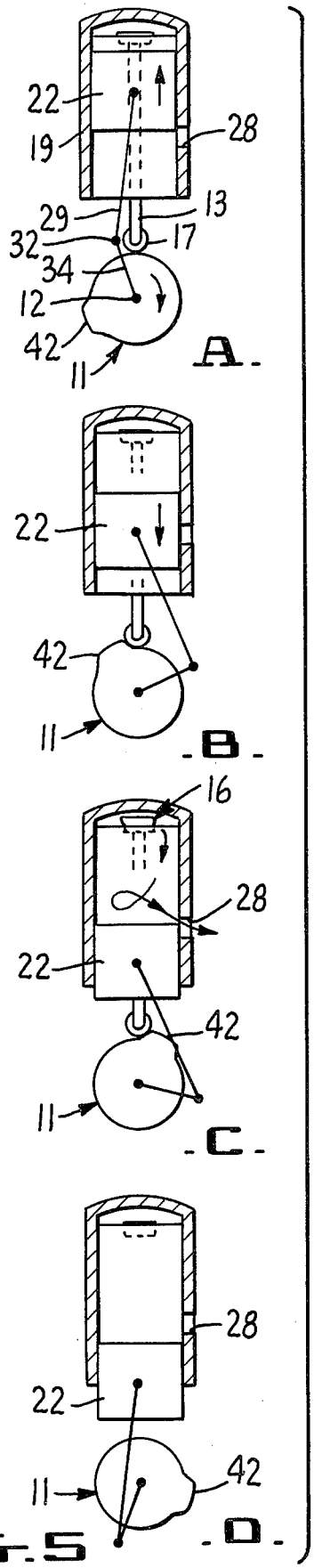
FIGS. 5A through 5D are schematic views of the relationship of the cam lobe and the intake valve at different points in the piston cycle.

As may best seen in FIG. 5, cam lobe 42 is positioned so that valve 16 starts to open before piston 22 uncovers exhaust port 28. When the combustion takes place in chamber 24, the rapidly explanding gases urge piston 22 downwardly in cylinder 21. The pressure of the combustion gases rapidly falls off, however, and at some point in the downward movement of the piston the pressure in the cylinder drops below the pressure in air intake passage 23, which may be supplied with air under pressure as from a supercharger (not shown). It is at this point that the cam lobe 42 begins to open valve 16. As the piston continues to descend because of momentum of the parts, including a separate fly wheel if desired, the exhaust port 28 is uncovered and the air and combustion gases in the cylinder 21, being at considerably higher pressure than the outside air, rush out through the exhaust port 28.

The intake valve 16 is closing in the position illustrated in FIG. 5C, and the piston 22 thereafter bottoms and begins to move upwardly on the compression stroke, still tending to force gases out of the cylinder 21 until exhaust port 28 is covered. From this point on, during the return stroke of the piston 22, the charge in the cylinder 21 is compressed until the spark plug 27 again fires and the piston 22 begins its power stroke. Although a carburetted fluid-air mixture may be supplied through intake passage 23, for reasons of economy it is preferred to inject fuel directly into the combustion chamber, as by fuel injector 44, during the compression stroke.

From the foregoing, it will be apparent that the novel engine and combined camshaft-crankshaft of the present invention are useful and valuable independently, and combine to provide a powerful, economical and clean engine which is simple and sturdy in construction and which has neither the expense nor problems of the separate camshaft and gear or belt drives that have previously been required.

What I claim as new and desire to secure by Letters Patent is:

1. An internal combustion engine comprising
a crankcase block with at least one cylinder attached,
a cylinder head on said cylinder,
a reciprocating piston in said cylinder being operatively coupled to a crankshaft;
said crankshaft rotating in said crankcase with at least one throw having peripheral gears as a power take off means, a lubrication means,
at least one cam affixed to the side of said crankshaft throw as a means of opening and closing at least one valve,
a trough in said crankcase whereby said peripheral gears pass thru lubrication,
a first aperature located in said cylinder,
a second aperature located in said cylinder,
a valve means for operatively opening and closing said first aperature,
said piston operatively opening and closing second aperature, and said first aperature operating exclusively for fuel intake, when said second aperature operates exclusively for exhaust, whereby said first and second aperatures are operatively interchangeable

2. An engine as described in claim 1 wherein said cam is generally circular with parallel ridges on the peripheral edge to retain roller for valve lifter means, and spring means biasing said roller, an elongated lifter rod adapted for coaxial connection to the stem of the valve.

3. An engine as described in claim 1 wherein said cam is formed on the side of an oil splash lubrication gear on said crankshaft throw.

4. An engine as described in claim 1 wherein said cam comprises an integral part of one of the throws of the crankshaft.

5. An engine as described in claim 1 wherein a plurality of said cams can be attached to said crankshaft throw for a multitude of types of internal combustion engines, as a means of activating valves, as a means of changing valve timing to better suit the performance of the engine.

6. An engine as described in claim 1 comprising a crankcase block, providing a cylinder, and wherein a lubrication gear is provided on said throw on which said cam is formed, and said crankcase is secured to said crankshaft, said crankcase being formed with parallel flanges providing a trough for said lubrication gear, the teeth passing thru lubricant providing a splash lubricating system and places said lubrication under pressure to the outer extremities.

7. An engine as described in claim 1 wherein said lubrication gear has the ability to provide power take off means thru aperatures in said crankcase, said gear can be interchangeable drive and driven along with both ends of said crankshaft.

8. An engine as described in claim 1 wherein said cam is generally round, has parallel flanges on the outer extremities and provides a means for conveying rotational energy as a valve activating means, located on said crankshaft throw allowing for replacement.

* * * * *